United States Patent [19]

Lancaster et al.

[11] Patent Number: 4,712,354

[45] Date of Patent: Dec. 15, 1987

[54] DUAL ROTATING STRETCH WRAPPING APPARATUS AND PROCESS

[75] Inventors: Patrick R. Lancaster; William G. Lancaster, both of Louisville, Ky.

[73] Assignee: Lantech, Inc., Louisville, Ky.

[21] Appl. No.: 903,896

[22] Filed: Sep. 4, 1986

Related U.S. Application Data

[63] Continuation of Ser. No. 582,779, Feb. 23, 1984, abandoned.

[51] Int. Cl.[4] ..... B65B 13/12

[52] U.S. Cl. ..... 53/399; 53/441; 53/588; 53/210; 53/176; 53/449

[58] Field of Search ..... 53/176, 449

[56] References Cited

U.S. PATENT DOCUMENTS

| | | | |
|---|---|---|---|
| 543,587 | 7/1895 | Wilson | 493/299 |
| 931,134 | 8/1909 | Kutz | 493/297 |
| 2,228,492 | 1/1941 | Wetherbee | 53/461 |
| 2,331,969 | 11/1940 | Friedrichs et al. | 493/299 |
| 2,502,638 | 4/1950 | Becht | 156/188 |
| 2,714,414 | 8/1955 | Ganahl et al. | 156/171 |
| 2,723,705 | 11/1955 | Collins | 156/177 |
| 2,731,067 | 1/1956 | Miller | 156/190 |
| 2,841,202 | 7/1958 | Hirschy | 156/426 |
| 3,023,787 | 3/1962 | Phillips et al. | 138/121 |
| 3,128,216 | 4/1964 | Reed | 156/190 |
| 3,230,123 | 1/1966 | Christensen | 156/195 |
| 3,279,333 | 10/1966 | Blair et al. | 493/274 |
| 3,318,242 | 5/1967 | Griffith | 100/13 X |
| 3,467,108 | 9/1969 | Wallace | 131/59 |
| 3,863,425 | 2/1975 | Edwards | 53/211 |
| 4,050,220 | 9/1977 | Lancaster | 53/556 |
| 4,173,108 | 11/1979 | Eglinton | 53/211 X |
| 4,235,062 | 11/1980 | Lancaster | 53/556 X |
| 4,317,322 | 3/1982 | Lancaster | 53/556 X |
| 4,470,251 | 9/1984 | Bettcher | 57/230 |

FOREIGN PATENT DOCUMENTS

| | | | |
|---|---|---|---|
| 2303590 | 8/1973 | Fed. Rep. of Germany | 53/210 |

*Primary Examiner*—John Sipos

*Attorney, Agent, or Firm*—Finnegan, Henderson, Farabow, Garrett & Dunner

[57] ABSTRACT

A novel apparatus and process for high speed continuous film web wrapping of uniform loads, in which a first wrap is applied in a first direction transverse to the path of the moving load and a second wrap is applied in a second direction opposite the first direction. This dual wrap nullifies the disabling effects of helical wrap bias when a single wrap is applied at high speed to a moving load, and produces a longitudinal containment force after film web recovery over time on leading and trailing ends of the load. In the apparatus two wrapping stations are provided together with a wrapping conveyor assembly which carries the film web wrapped around the load and conveyor through the two stations. Each station includes a dispensing ring on which a film roll and an elongation mechanism are mounted, a drive motor to rotate the ring and means to drive the elongation mechanism to draw film web from the roll and stretch the same beyond its yield point at ambient temperature on its path from the roll to the load and conveyor. The regulation of elongation in the elongation mechanism and the regulation of film supply speed from the elongation mechanism are independent of film demand speed at the load.

33 Claims, 8 Drawing Figures

FIG. 3
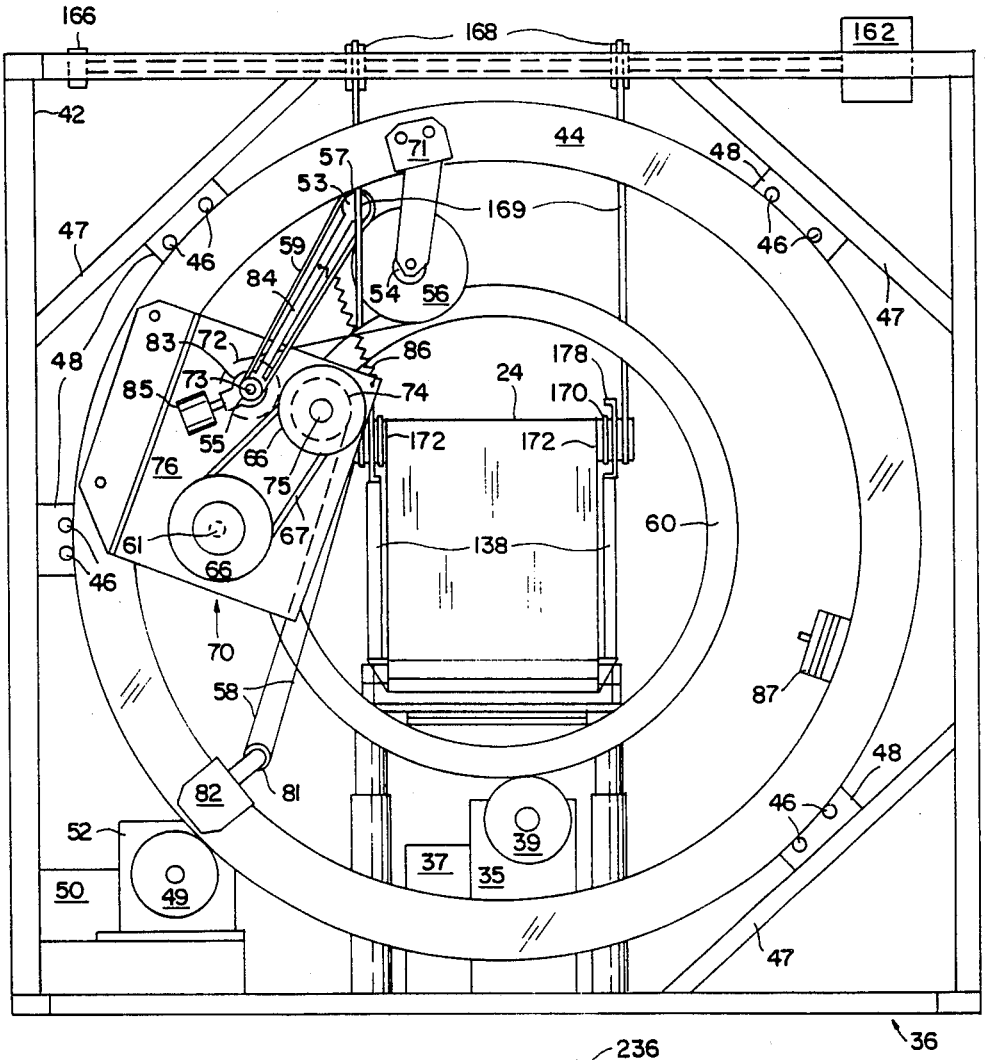
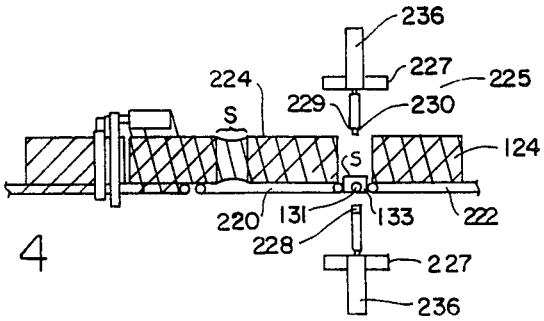
FIG. 4

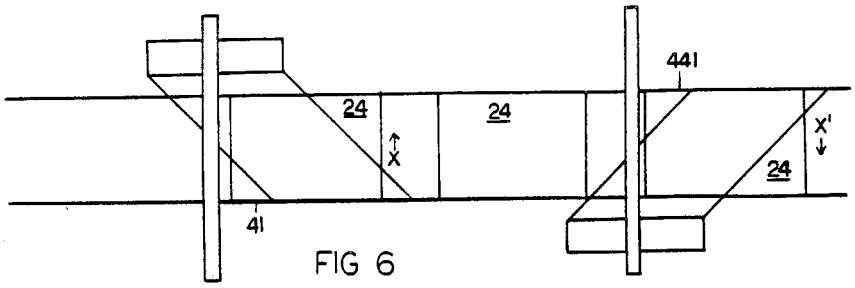
FIG 6
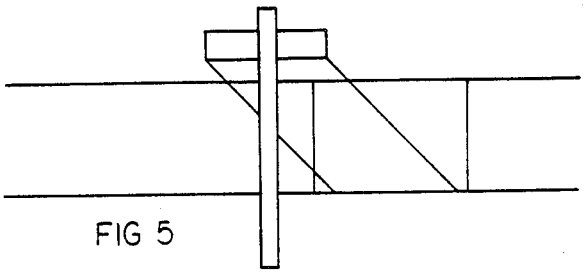
FIG 5
FIG 7
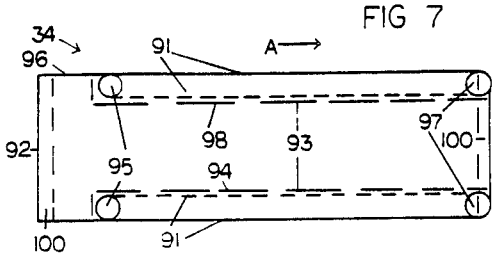

DUAL ROTATING STRETCH WRAPPING APPARATUS AND PROCESS

This application is a continuation of application Ser. No. 582,779, filed Feb. 23, 1984 now abandoned.

BACKGROUND OF THE INVENTION

The present invention generally relates to packaging and more particularly is directed to a rotating stretch wrapping apparatus for making unitary packages which hold a plurality of components, each package containing a load wrapped in a web of stretched film.

Case packing or boxing is a common way of shipping multiple unit products. Multiple unit products are generally stacked in a corrugated box or are wrapped with kraft paper with the ends of the kraft paper being glued or taped.

Some manufacturers use strapping of vertical steel or plastic binding to unitize the product. The problems incurred in the use of strapping are the requirement of costly corner protectors, danger of bending or snapping and injuring the operator while applying this high tension material to the loads, the ever present problem of settling due to moisture wetting the cartons, and the sides bulging or normal vibrations causing the straps to loosen and the load to come apart.

Glue is an alternative method used in some areas, but customers are not satisfied with gluing because removal of glued cartons or bags from the unitized loads tends to tear outside layers of the cartons. Glue, although inexpensive by itself, demands interleaving for product orientation and thus requires more durable and expensive packaging material.

Because of the lack of alternatives of packaging, tape is currently being used to horizontally bind the top layer of the load. However, tape is expensive and allows relatively free movement of all products surrounded.

Another way of unitizing products is to put a sleeve or covering of heat shrinkable material around the products and shrink the sleeve to form a unitized package. Although heat shrink technology has been utilized to place a wrap with containment force on all load sides, the wrap lacks elasticity and the process is costly in materials and heat energy. Some loads are destroyed by exposure to heat. The use of heat shrinkable film is described in U.S. Pat. Nos. 3,793,798; 3,626,645; 3,590,549 and 3,514,920. A discussion of this art is set forth in U.S. Pat. No. 3,867,806.

An economical way of packaging products is by wrapping the product load with a web of stretched plastic film.

The elasticity of the stretched plastic film holds the products of the load under more tension than either shrink wrap or kraft wrap, particularly with products which settle when packaged. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application. Containment force is currently achieved by maximizing elongation until just below a critical point where breaking of the film occurs.

The use of wrapping machinery to wrap stretched film around a load is well known in the art. Four types of stretch wrapping apparatus are commonly used in the packaging industry and these types are generally described as spiral rotary machines, full web rotary machines, passthrough machines, and circular rotating machines.

A typical spiral machine is shown in U.S. Pat. No. 3,863,425 in which film is guided from a roll and wrapped around a cylindrical load in a spiral configuration. A carriage drives the film roll adjacent the surface of the load to deposit a spiral wrap around the load and returns in the opposite direction to deposit another spiral overwrap around the load.

Spiral wrapping machines which are currently commercially available are manufactured by Lantech, Inc. under Model Nos. SVS-80, SVSM-80, STVS-80, STVSM-80 and SAHS-80.

A full web type of apparatus which wraps stretched film around a rotating load is disclosed in U.S. Pat. No. 3,876,806 assigned to Lantech, Inc. A similar full web apparatus using a tensioned cling film wrapped around a rotating load is shown by U.S. Pat. No. 3,986,611 while another apparatus using a tacky PVC film is disclosed in U.S. Pat. No. 3,795,086.

Full web wrapping machines typical of those presently commercially available are Model Nos. S-65, T-65 and SAH-70 manufactured by Lantech, Inc.

Another type of machine for wrapping a pallet load commonly called a passthrough machine is disclosed in U.S. Pat. No. 3,596,434. In this reference a pallet load is transported along a conveyor and the leading face of the pallet load contacts a vertical curtain of film formed by the sealed leading edges of film webs dispensed by two rolls of film on opposite sides of the path of the pallet load. The pallet load continues to move along the conveyor, carrying with it the sealed film curtain until the two side faces of the pallet load as well as the front face are covered by film web. A pair of clamping jaws then closed behind the pallet load, bringing the two film web portions trailing from the side faces of the pallet load into contact with one another behind the pallet. The jaws then seal the film web portions together along two vertical lines, and cut the web portions between those two seals. Thus, the film web portions are connected to cover the trailing face of the pallet load, and the film curtain across the conveyor is re-established to receive the next pallet load. The pallet load may subsequently be exposed to heat in order to shrink the film web thus applying unitizing tension to the load, as is disclosed in U.S. Pat. No. 3,662,512. Commercial passthrough machines are currently manufactured by Weldotron, Arenco, and SAT of France.

Various apparatus and processes have been developed to rotatably wrap stacked components to form a load.

Stationary loads which are brought to a loading area and are wrapped by a rotating member which dispenses stretched film around a load are disclosed in U.S. Pat. Nos. 4,079,565 and 4,109,445. U.S. Pat. No. 4,079,565 discloses a full web vertical wrap of the load while U.S. Pat. No. 4,109,445 discloses the horizontal spiral wrap of a load. U.S. Pat. No. 4,050,220 discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll of material is rotated about the load and the supporting planar surfaces, wrapping the load and the supporting surfaces together. Plastic wrapping material is stretched during the wrapping operation so that the material is under tension when applied to the load. After the wrapping cycle is complete, the load is pushed past the ends of the supporting surfaces, and the wrapping material which covered the supporting surfaces collapses against the supported sides of the load. Further developments of this wrapping system are disclosed in U.S. Pat. Nos. 4,110,957 and 4,178,734.

U.S. Pat. No. 603,585 discloses a spiral wrapping device for enclosing individual newspapers in paper wrap for mailing purposes.

Each newspaper is placed on a cylindrical core with a circumference approximately twice that of a newspaper, and each newspaper advances along the length of the core as the core is rotated. Wrapping paper is applied to the core at an angle and the wrapping paper between newspapers is severed as each newspaper reaches the end of the cylinder and is placed on a flat horizontal surface, thereby collapsing the wrapping paper against the underside of the newspaper previously pressed to the cylinder.

U.S. Pat. No. 1,417,591 discloses a wrapping machine for individual items such as boxes in which each such item is conveyed along the surface of a horizontal sheet of wrapping material. The edges of wrapping material on each side of an item are curled upward to meet one another atop the item to be wrapped thereby forming a tube around the item. The leading end of the tube is sealed and the trailing end of the tube is severed and then sealed to enclose the item. Another device which utilizes this system of wrapping is disclosed in U.S. Pat. No. 3,473,288.

In U.S. Pat. No. 2,575,467, a wrapper of cylindrical packages for material such as sausage is disclosed in which the package is rotated about its cylindrical axis as wrapping tape is applied at an angle to form a cylindrical wrap.

In U.S. Pat. No. 2,863,270, two cylindrical items of approximately equal diameter are abutted at their planar ends, and placed by hand in a cradle which exposes the complete circumference of the abutting ends. A roll of wrapping material is then driven by a hand crank mechanism to circulate around the circumference of the abutting ends, applying wrapping material thereto. When sealed together, the pair of cylindrical items are removed from the cradle by hand.

A spiral wrapping machine for long bundles of items such as filaments is disclosed in U.S. Pat. No. 3,000,167. As the bundle of filaments moves along its axis through the wrapping area, a ring circulates about the bundle carrying a roll of wrapping material which is applied to the bundle to form a spiral wrap pattern. Because the normal load of filaments or similar items is much longer than the wrapping area, it is not necessary to provide support for the bundle in the wrapping area, and therefore no support structure is wrapped with the bundle.

Commercial circular rotating wrapping machines are presently manufactured by Lantech, Inc. under the trademark LANRINGER, and are provided with wrapping ring inner diameters of 36 inches, 54 inches, 72 inches, and 84 inches. In differentiating between the various circular rotating wrapping machines manufactured by Lantech, Inc., the manual model has the designation SR; the full web models have the designations SVR and SAVR; the multiple banding models have the designation SVBR and SAVBR; the spiral models have the designation SVSR and SAVSR, and the continuous wrap or bundler models have the model designations SVCR and SAVCR.

U.S. Pat. Nos. 4,302,920 and 4,317,322, assigned to Lantech, Inc., disclose a pre-stretch film elongation system mounted adjacent a film roll and rotated about a stationary load. The pre-stretch system which is mounted on the rotating ring includes an upstream roller and a downstream roller across which the film web successively passes. The two rollers are speed coupled by gears, belts, or the like, which force a constant ratio of angular velocity between the rollers. Film is drawn from the film roll and across each of the rollers by relative rotation of the ring around the load. The fixed speed ratio between the upstream and downstream rollers, in which the downstream roller moves more quickly than the upstream roller, causes substantial stretching between the rollers of the web. However, it should be noted that the film elongation system is completely powered and controlled by the film web itself as it is being pulled by the load. In this device the substantial changes in demand speed are transmitted directly from the load back through the web to the pre-stretch device. The payout of film is controlled by the shape and size of the load and transmitted through the film web itself. Because of the inertial forces due to rapid acceleration and deceleration of rotation of the film roll and rollers, there is a significant variation in the force on the film between the dispenser and the load.

All of the circular rotating devices mentioned above exhibit an upper limit to the throughput rate, or rate at which loads can be moved and wrapped affectively. Typically, an increase in throughput is attempted by merely increasing the rotation speed of the ring carrying the film dispenser, which increases force experienced by the load, while at the same time increasing the speed of the conveyor carrying the loads through the rotating ring. This attempt results in a spiral wrapping pattern around each load, with the film being stretched on a diagonal to the load path. Three forces are exerted on the load by this wrap: a circumferential or encircling containment force, a longitudinal or end-to-end containment force, and a helical force which causes a helical displacement of units within each load. As a result of this "corkscrew" displacement, the load becomes unstackable, prone to collapse, and likely to reduce overall circumference and loosen the film wrap as the units within shift, thereby reducing the commerical value of the load. Moreover, all of the prior art circular rotating stretch devices apply containment forces only to the load surfaces which cross the plane of the rotating ring. No containment force is applied on surfaces parallel to the ring plane, such as leading and trailing ends. Hence, there remains a clear need and use for a circular rotating wrapping apparatus and process which can operate at high throughput without the disabling effects of helical stretch bias, and which applies containment force at leading and trailing load ends.

SUMMARY OF THE INVENTION

Herein is disclosed a novel apparatus and process for continuous wrapping of uniform loads, each comprising a plurality of units, in which each load is wrapped twice. The first wrap is applied in a first direction with a resulting first helical bias, and the second wrap is applied in an opposite direction with a resulting opposite helical bias. Thus, the helical forces of the two wraps add together to balance each other. The combined longitudinal wrap forces do not cause significant unit displacement, and longitudinal film recovery at load ends after stretching beyond the yield point allows sealing of untensioned film followed by end-to-end containment force buildup due to film web recovery over time. These characteristics of the present invention allow both wrapping and sealing to proceed at a higher pace than was previously thought possible. This in turn leads to more rapid throughput and return on investment.

According to the invention, two consecutive wraps are applied by rotatable wrapping apparatuses at two consecutive wrapping stations along the load path. As illustrated schematically in FIG. 4, the wrap is applied in a first direction across the direction of load motion, resulting in a wrap exhibiting helical bias and unit displacement within the load. At the second wrapping station, a second wrap is applied in a direction opposite the direction of the first wrap, resulting in an opposite helical bias with a unit displacement opposite that of the first wrap. Thus, the two helical wrap forces balance one another, resulting in a stable load without unit displacement.

The film dispenser utilized at each wrapping station may advantageously be one which dispenses film at a supply speed independent of the varying takeup or demand speed of film at the load. Each film dispenser also includes a film stretching mechanism which elongates the film web above its yield point at ambient temperature prior to application thereof to the load, as is described herein. Other film dispensing and pre-stretching mechanisms which may be utilized in the present invention include those disclosed in U.S. Pat. No. 4,302,920 and our prior copending application Ser. No. 411,995.

Thus, it is clear that the present inventive apparatus and process provide a distinct and widely-demanded improvement over the prior art, in that consecutive uniform loads are unitized without exposure to heat, stabilized and sealed at high throughput. The resulting wrap exerts containment force and elasticity on all load sides. These characteristics are presently demanded by distribution facilities and warehouses at which high volume shipments are broken down to smaller quantities for distribution to retail outlets or end users.

Although the invention is set forth in the claims, the invention itself, and the method by which it is made and used may be better understood by referring to the following description taken in connection with accompanying drawings forming a part hereof, in which like reference numerals refer to like parts throughout the several views and in which:

BRIEF DESCRIPTION OF THE DRAWINGS

FIG. 3 is a front cutaway view taken along line 3'—3' of the apparatus of FIG. 2;

FIG. 4 is a schematic sideview illustrating a continuous wrapping and severing operation conducted with the apparatus of FIG. 1;

FIG. 5 is an overhead schematic view of a typical prior art wrapping apparatus;

FIG. 6 is a top plan schematic view of the apparatus of FIG. 1;

FIG. 7 is an isolated top plan view of the wrapping conveyor assembly of the apparatus of FIG. 1.

DETAILED DESCRIPTION OF THE DRAWINGS

Figure 1:
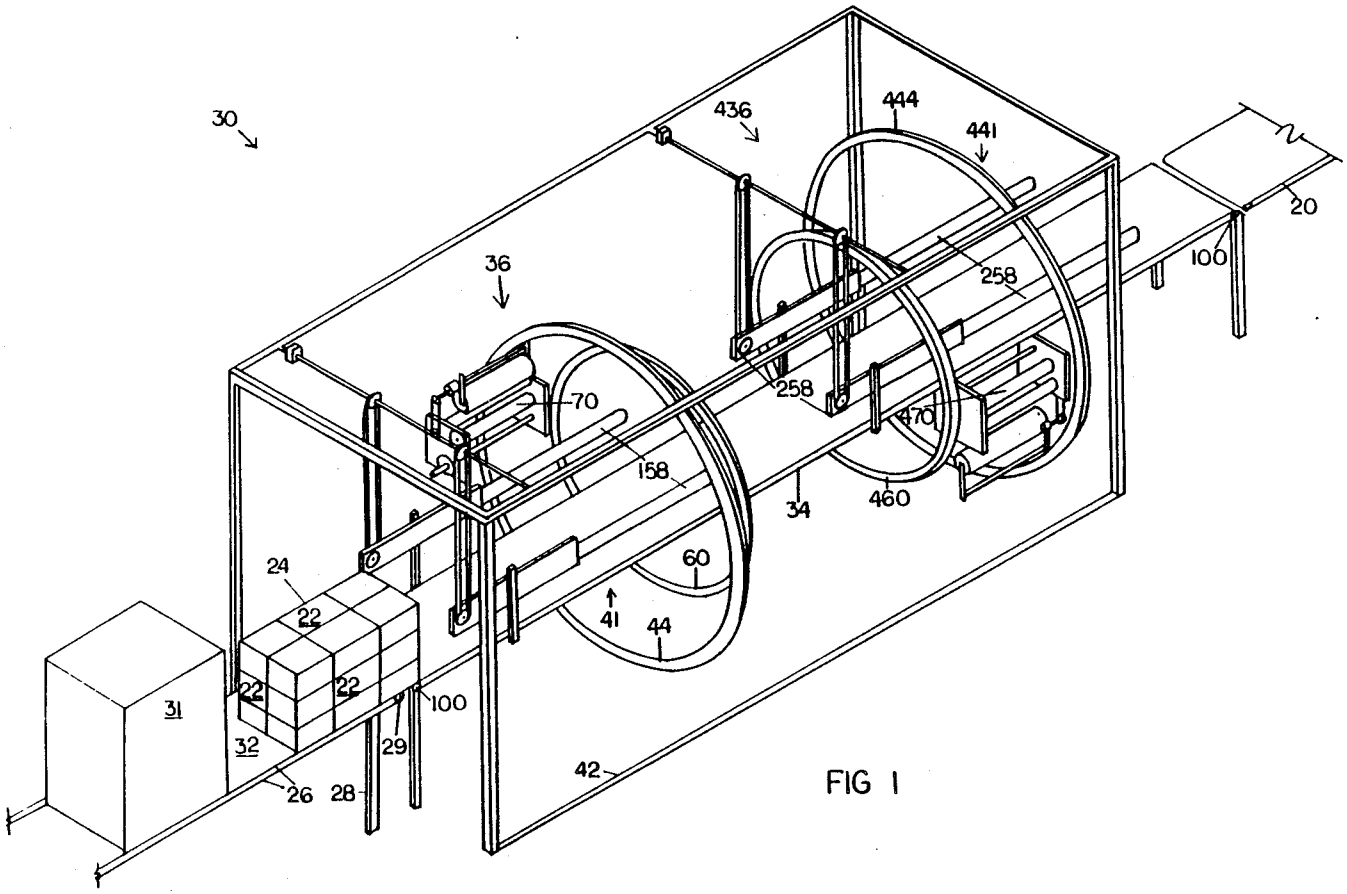
FIG. 1 is an elevated perspective view of the present inventive apparatus.
Figure 2:
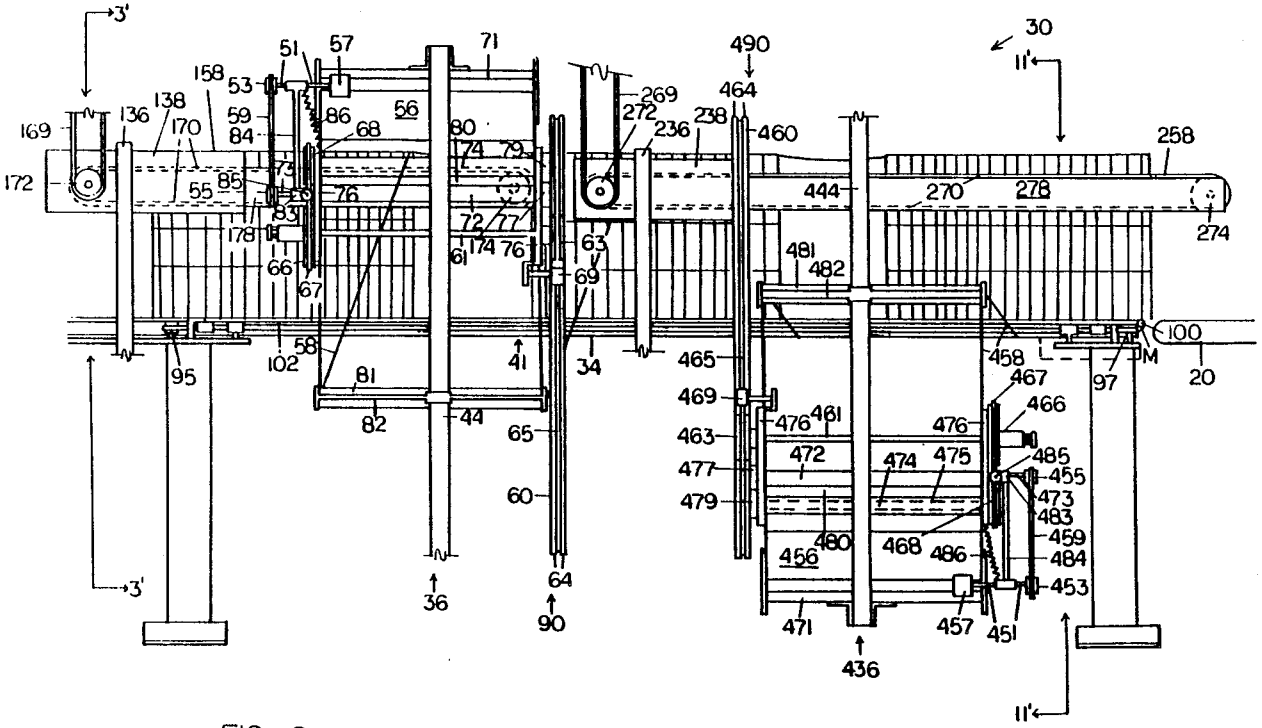
FIG. 2 is an opposite side elevational view the apparatus of FIG. 1.

The best mode and preferred embodiment of the present invention is disclosed in FIGS. 1 through 3, which shows a ring wrapping apparatus 30 comprising a feed conveyor 32, a wrap and load conveyor assembly 34, two film dispensing mechanisms 36 and 436 with a take-off conveyor 20.

As shown in FIG. 1, a plurality of units 22 forming a load 24 have been loaded in a stacked relationship on an infeed conveyor assembly 32 by either manual or mechanical means. It should be noted that the load, depending on its nature and composition, may or may not require spacing. A loading device 31 is schematically shown and may be one of a number of types of stacking or placing devices which are well known in the art to place a stack of cartons or materials into a designated area.

In the preferred embodiment, the load 24 is placed on an infeed conveyor 32 which is comprised of an endless belt 26 mounted on a frame support 28.

Alternate embodiments of the infeed conveyor could take the forms of, for instance, descending freewheel rollers or a hydraulic or pneumatic pushing device (not shown) which can be used to engage each load 24 with a platen to push the load into the wrapping area. However, the conveyor embodiment is preferred and the conveyor belts of the present invention are preferably textured to develop a high coefficient of friction against the loads.

The conveyor belt 26 as seen in FIG. 1 is mounted on rollers 29 which are rotatably journalled by suitable bearing means in brackets which are secured to the frame support 28. The infeed conveyor 32 carries the loads 24 to a first wrapping station 41 comprising a film dispensing apparatus 36, and a wrapping conveyor assembly 34.

The first film dispenser 36 as shown in FIG. 3 comprises a frame 42 on which a steel "donut" or ring-shaped film support member 44 is rotatably mounted and supported on three planes by guide rollers 46. If desired, the film support member 44 can be constructed of aluminum. A plurality of guide rollers 46 project inward from the frame 42 on arms 47 and mounting plates 48 to engage the ring member 44 so that it will rotate in a predetermined plane. A friction drive wheel 49 is positioned adjacent the ring member 44 at its base and engages the ring member 44 to rotate the ring member 44 within the guide wheel rolling area. The friction drive wheel 49 is driven by a motor 50 having a shaft which is suitably connected with a drive reducer 52. A material roll dispensing shaft 54 is rotatably secured on bracket 71 to the right member 44 for rotation on its axis and is adapted to receive and hold a roll of film material 56. A belted drive ring 60 coaxial with and parallel to ring member 44 is rotatably mounted to frame 42, in a manner substantially as described above for ring member 44. A friction drive wheel 39 is positioned in contact with ring 60 and driven by motor 37 which may be a variable speed or reversible motor, through reducer 35 to rotate ring 60. Alternatively, ring 60 may be fixed to frame 42.

The film web is passed through a pre-stretching or elongation mechanism 70 and is tucked or fastened underneath the load. The pre-stretching mechanism 70, which is best seen in FIGS. 2 and 3, comprises connected roller members 72 and 74 which are rotatably mounted respectively on shafts 73 and 75 which are in turn journalled into a housing 76. The housing 76 is mounted to ring member 44 across the plane of ring member 44. The rollers 72 and 74 are interconnected by speed control means comprising gears 77 and 79 mounted respectively to shafts 73 and 75. Gears 77 and 79 mesh together and operate so that the film web 58 passes first across the upstream roller 72 and then across the downstream roller 74 as it is pulled from film roll 56 to the load 24, with the downstream roller 74 driven at a faster rate than the upstream roller 72, causing the film to be accelerated and stretched preferably beyond its yield point and preferably at ambient temperature in a narrow space 80 between the two rollers. The ratio of the gear 77 to the gear 79 preferably ranges from 5:4 to 4:1. More specifically, the ratio of the gears should be at least 2:1 in order to stretch film material passing across the rollers beyond the yield point of the material. It should be recognized that film material so stretched not only gains in tensile strength, but also will recover or retract to an elongation level less than the elongation level achieved during passage between the rollers. When stretched film is applied around a surface of constant circumference, such as a load, film recovery causes an increase in containment force on the load. However, film stretched beyond its yield point does not recover instantaneously, and the method of the present invention completes the load wrapping and sealing well before recovery produces the final tension in the film. Advantages of this condition will be further set forth below.

If the rollers 72 and 74 supply film at a constant speed, then there is no deceleration which could cause film roll 56 to spill film. Thus, the speed of roll 56 need not be independently regulated and a small amount of friction may be exerted constantly on film roll mandrel 54, so that roll 56 will stop spinning when the ring member 44 stops rotating. If it is necessary to accommodate frequent starts and stops of the ring member 44, a pivoting collar 83 is placed around upstream roller shaft 73, and a counterweight 85 and contact frame 84 are mounted at angles to the collar 83. At an end of frame 84 opposite the collar 83, a contact roller shaft 51 is rotatably mounted to frame 84 and carries contact roller 57. Shaft 51 also carries contact roller pulley 53, and upstream shaft 73 carries upstream pulley 55. Pulleys 53 and 55 are surrounded by belt 59, and the ratio of pulley sizes and the circumference of roller 57 are chosen so that the linear surface speed of roller 57 is no greater than the linear speed of upstream roller 72. A coil spring 86 is coupled to frame 84 and housing 76 so as to constantly urge contact roller 57 against the surface of film roll 56 which decreases in radius as film web 58 is paid out during wrapping. Spring 86 forces the roller 57 to maintain contact with the surface of roll 56 during rotation of ring member 44. Counterweight 85 exerts leverage on frame 84 to balance the effect of the force of gravity on roller 57 as ring member 44 rotates. Therefore, friction between roller 57 and film roll 56 will be maintained, and pay out speed of film web 58 from roll 56 will accelerate and decelerate precisely to match starts and stops of ring member 44.

To maintain balance of ring member 44 counterweight 87 is mounted to ring member 44 opposite elongation mechanism 70.

The elongated drive mechanism 90 is best understood by referring to FIGS. 2 and 3. A power shaft 61 is journalled to and extends beyond housing 76 at least to the plane of ring 60. A power pulley 63 is mounted on power shaft 61 in the plane of ring 60. Ring 60 is channeled to define side walls 64, and power belt 65 encircles ring 60 in the channel between the walls 64. Belt 65 also is distended from ring 60 outward to pass around pulley 63. A tensioner roller 69 mounted to frame 76 presses inward on belt 65 to maintain tension on belt 65 when rotary ring member 44 and stationary ring 60 are not precisely circular or coaxial. Thus, during relative rotation of rings 60 and 44, power pulley 63 is driven in the opposite direction by friction with belt 65. If desired, belt 65 and pulley 63 may be provided with teeth to minimize slippage. Also the surface of ring 60 between walls 64 may be covered with material chosen to maximize friction with belt 65.

Alternatively, power could be transferred to shaft 61 by direct contact with ring 60 as disclosed in our prior copending application Ser. No. 411,995.

At the other end of power shaft 61 distal from the stationary ring 60, the shaft 61 again passes through housing 76. A transfer pulley 66 is mounted to this end of shaft 61. On the same side of housing 76, downstream roller shaft 75 extends through housing 76, and downstream pulley 68 is mounted to downstream shaft 75. A transfer belt 67 is mounted on pulleys 66 and 68 so that downstream roller 74 is rotated in the same direction as power pulley 63. Pulley 66 may be a variable pulley for adjustment of the ratio of ring rotation speed to film payout speed. Alternatively, ring 60 may be mounted for rotation in a manner similar to ring 44, and the rotation speed of ring 60 may be varied to change the net action of belt 65 and pulley 63, thus altering the film payout speed.

Returning again to the end of housing 76 adjacent stationary ring 60, downstream gear 79 is mounted to downstream roller shaft 75, and engages upstream gear 77 which is mounted to upstream roller shaft 73. Thus, upstream roller 72 rotates in the opposite direction of downstream roller 74 and power pulley 63.

Film roll shaft 54 is mounted to bracket 71 across ring member 44 at a distance from upstream roller 72 which is at least equal to the radius of a full film roll 56. Film 58 is dispensed from roll 56 across the far side of upstream roller 72, then in an "S" curve between the upstream and downstream rollers and across the downstream roller 74. It can readily be seen that both the regulation of the film supply speed across roller 74 and the regulation of elongation achieved between rollers 72 and 74 are independent of variations in demand for film at load 24. A film path extension means comprising an idler roller 81 is journalled to an idler roller bracket 82 mounted to and across the plane of ring member 44. Film web 58 passes from the downstream roller 74 around idler roller 81 and then onto the load. Idler roller 81 must be positioned less than 90 degrees around ring member 44 from the downstream roller 74, in order to avoid contact of film 58 with the load between the downstream roller 74 and the idler roller 81. The idler roller 81 must also be separated from the downstream roller 74 a distance sufficient to avoid film web contact with housing 76, and also sufficient to expose a large area of film 58 to force variance caused by cornering on the load during wrapping. Bracket 82 may be fixedly mounted perpendicular to ring member 44 or fixed thereto in an angled orientation, or gimballed thereto so that it "floats" or adjusts orientation on one or two axes in response to film path angles.

As best seen in FIGS. 2 and 3, a pair of side conveyors 158 are positioned on either side of the load path and are in close proximity or in contact with opposing vertical side faces of the load 24. Each side conveyor 158 comprises a bracket 136 secured to the frame, a skid-sleeve support 138 supported by the bracket 136, skid-sleeve 178 supported by the skid-sleeve support 138, and upstream pulley 172 and a downstream pulley 174 at opposite ends of the skid-sleeve 178. A side conveyor belt or chain 170 circulates in a downstream direction while exposed at an upper edge of skid-sleeve 178, and then returns in an upstream direction within skid-sleeve 178. Belt 170 encircles pulleys 174 and 172. Upstream pulley 172, bracket 138 and support 136 are preferably located upstream from the wrapping station 41, while the skid-sleeve 178 preferably extends downstream through the wrapping station 41.

A side conveyor motor 162 is mounted to an overhead portion of frame 42, and is coupled to shaft 164 so as to rotate shaft 164 about its axis. An opposite end of shaft 164 is journalled to bearing 166 also coupled to an upper portion of frame 42. A pair of pulleys 168 are mounted to axle 164 directly above each of the two pulleys 172. A vertical belt 169 encircles each overhead pulley 168 and a second sheave of pulley 172 below. Therefore, operation of motor 162 will drive the circulation of side conveyor belts 170. As the upper portion of belt 170 moves downstream, it carries with it any film web 58 which may be wrapped around the load and the skid-sleeve 178. Skid-sleeve 178 is preferably configured of a material chosen for low friction with the film web 58. As each wrapped load passes the downstream end of each side conveyor 158, the tensioned film web which is wrapped against the load 24 will move off of the side conveyors 158 and resume its memory position against the side vertical face of the load 24. Thus, the side conveyors 158 are especially well adapted for maintenance of load integrity under high and variable forces applied during wrapping of the load, and make the present invention especially useful for wrapping loads composed of large numbers of relatively small units.

The second film dispenser 436 surrounds conveyor assembly 34 so as to receive loads 24 previously wrapped by dispenser 36. It is a mirror image of dispenser 36 and is rotated in the opposite direction to counteract helical bias of the wrap.

Figure 8:
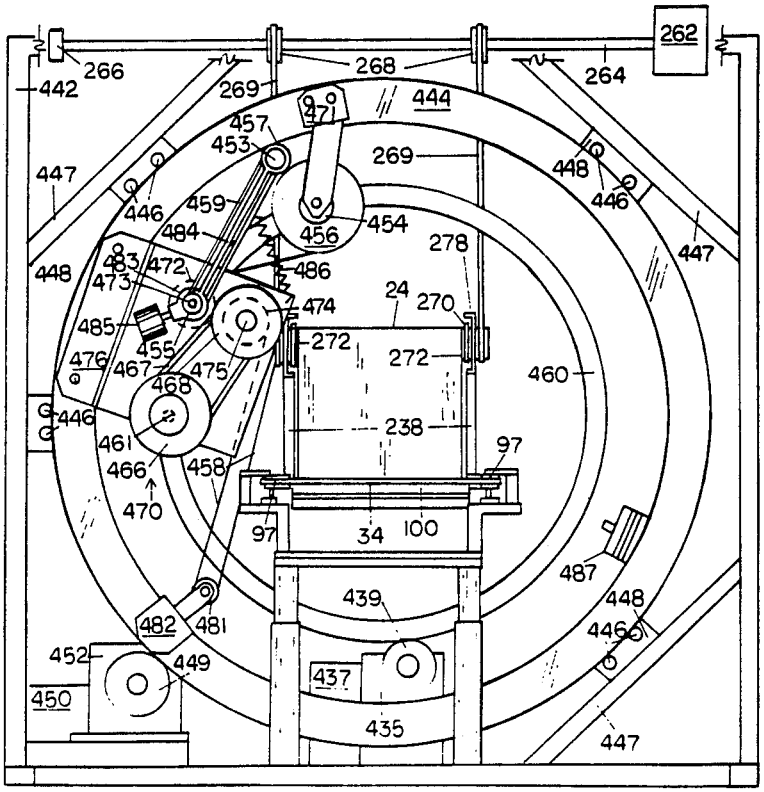
FIG. 8 is a rear cutaway view taken along line 11'—11' of the apparatus of FIG. 2.
Figure 9:
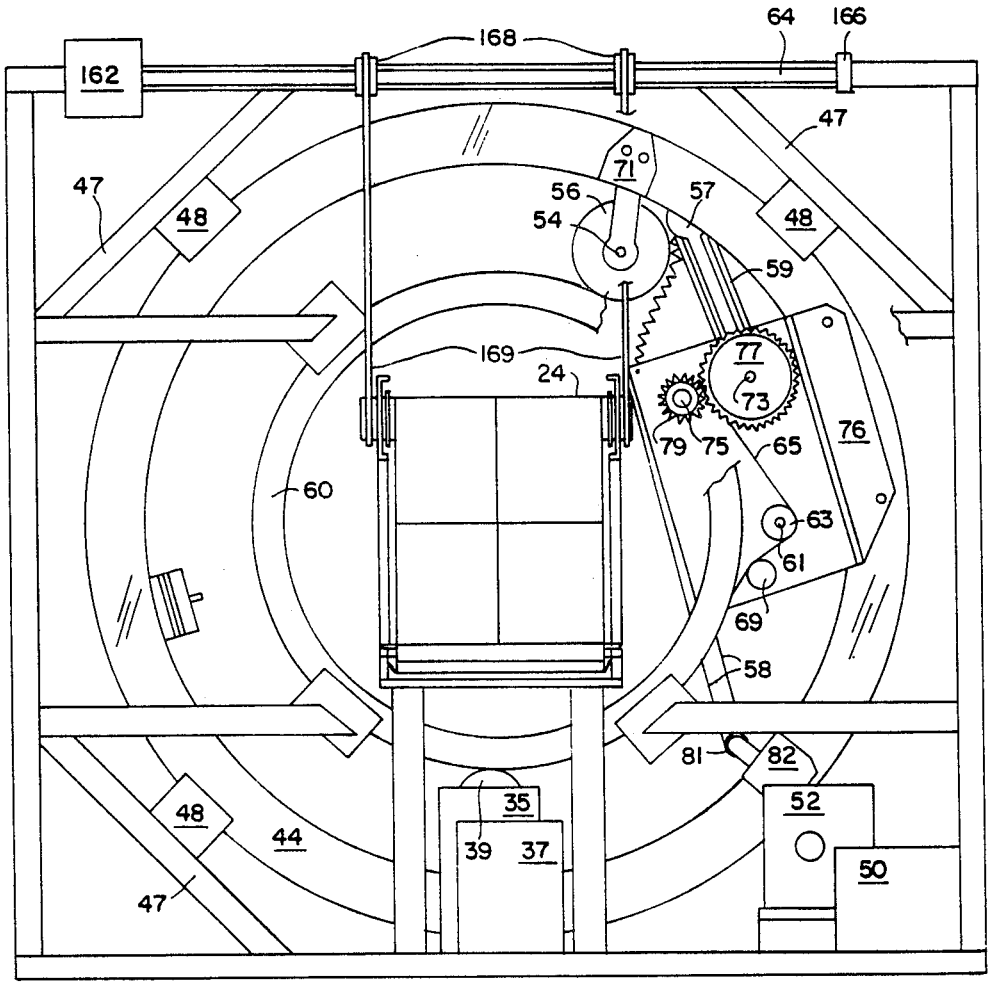

As best seen in FIG. 8, the second film dispenser 436 comprises a frame 442 on which a steel "donut" or ring-shaped film support member 444 is rotatably mounted and supported on three planes by guide rollers 446. If desired, the film support member 444 can be constructed of aluminum. A plurality of guide rollers 446 project inward from the frame 442 on arms 447 and mounting plates 448 to engage the ring member 444 so that it will rotate in a predetermined plane. A friction drive wheel 449 is positioned adjacent the ring member 444 at its base and engages the member 444 to rotate the member 444 within the guide wheel rolling area. The friction drive wheel 449 is driven by a motor 450 having a shaft which is suitably connected with a drive reducer 452. A material roll dispensing shaft 454 is rotatably secured on bracket 471 to the ring member 444 for rotation on its axis and is adapted to receive and hold a roll of film material 456. A belted drive ring 460 coaxial with and parallel to ring member 444 is rotatably mounted to frame 442, in a manner substantially as described above for ring member 444, on a side of ring member 444 opposite that of film roll 456. A friction drive wheel 439 is positioned in contact with ring 460 and driven by motor 437 which may be a variable speed or reversible motor, through reducer 435 to rotate ring 460. Alternatively, ring 460 may be fixed to frame 442.

The film web is passed through a pre-stretching or elongation mechanism 470 which is best seen in FIGS. 11 and 2 and comprises connected roller members 472 and 474 which are rotatably mounted on respective shafts 473 and 475 which are in turn journalled into a housing 476. The housing 476 is mounted to ring member 444 on housing bracket 471 across the plane of ring member 444. The rollers 472 and 474 are interconnected by speed control means comprising gears 477 and 479 mounted respectively to shafts 473 and 475. Gears 477 and 479 mesh together and operate so that the film web 458 passes first across the upstream roller 472 and then across the downstream roller 474 as it is pulled from film roll 456 to the loads 424, and the downstream roller 474 is driven at a faster rate than the upstream roller 472, causing the film to be accelerated and stretched preferably beyond its yield point in a narrow space 480 between the two rollers. The ratio of the gear 477 to the gear 479 preferably ranges from 5:4 to 4:1. Preferably the ratio is at least 2:1 in order to stretch the film material of its yield point. As described with regard to the elongation mechanism 70, the film web is stretched by passage across the rollers 472 and 474 and will recover or retract to some lesser elongation during a time interval following passage across the rollers.

If the rollers 472 and 474 supply film at a constant speed, then there is no deceleration which could cause film roll 456 to spill film. Thus, the speed of roll 456 need not be independently regulated and a small amount of friction may be exerted constantly on film roll mandrel 454, so that roll 456 will stop spinning when the ring member 444 stops rotating. Alternatively, if it is necessary to accommodate frequent starts and stops of the ring member 444, a pivoting collar 483 may be placed around upstream roller shaft 473, and a counterweight 485 and contact frame 484 may be mounted at angles to the collar 483. At an end of frame 484 opposite the collar 483, a contact roller shaft 451 is rotatably mounted to frame 484 and carries contact roller 457. Shaft 451 also carries contact roller pulley 453, and upstream shaft 473 carries upstream pulley 455. Pulleys 453 and 455 are surrounded by belt 459, and the ratio of pulley sizes and the circumference of roller 457 are chosen such that the linear surface speed of roller 457 is no greater than the linear speed of upstream roller 472. A coil spring 486 is coupled to frame 484 and housing 476 so as to constantly urge contact roller 457 against the surface of film roll 456 which decreases in radius as film web 458 is paid out during wrapping. Spring 486 counteracts the tendency of roller 457 to move away from the surface of roller 456 during rotation of ring member 444 due to centrifugal force. Counterweight 485 exerts leverage on frame 484 to balance the effect of the force of gravity on roller 457 as ring member 444 rotates. Therefore, constant contact of roller 457 and film roll 456 will be maintained, and pay out speed of film web 458 from roll 456 will accelerate and decelerate precisely to match starts and stops of ring member 444.

To maintain balance of ring member 444, counterweight 487 is mounted ring member 444 opposite elongation mechanism 470.

Elongation drive mechanism 490 is best understood by referring to FIG. 2. A power shaft 461 is journalled to and extends beyond housing 476 at least to the plane of ring 460. A power pulley 463 is mounted on power shaft 461 in the plane of ring 460. Ring 460 is channeled to define side walls 464, and power belt 465 encircles ring 460 in the channel between the walls 464. Belt 465 also is distended from ring 460 outward to pass around pulley 463. A tensioner roller 469 mounted to frame 476 presses inward on belt 465 to maintain tension on belt 465 when rotary ring member 444 and stationary ring 460 are not precisely circular or coaxial. Thus, during relative rotation of rings 460 and 444, power pulley 463 is driven in the opposite direction by friction with belt 465. If desired, belt 465 and pulley may be provided with teeth to minimize slippage. Also the surface of ring 460 between walls 464 may be covered with material chosen to maximize friction with belt 465.

Alternatively, power could be transferred to shaft 461 by direct contact with ring 460 as disclosed in our prior copending application Ser. No. 411,995.

At the end of power shaft 461 opposite the stationary ring 460, the shaft 461 again passes through housing 476. A transfer pulley 466 is mounted to this end of shaft 461. On the same side of housing 476, downstream roller shaft 475 extends through housing 476, and downstream pulley 468 is mounted to downstream shaft 475. A transfer belt 467 is mounted on pulleys 466 and 468 so that downstream roller 474 is rotated in the same direction as power pulley 463. Pulley 466 may be a variable pulley for adjustment of the ratio of ring rotation speed to film payout speed. Alternatively, ring 460 may be mounted for rotation in a manner similar to ring 444, and the rotation speed of ring 460 may be varied to change the net action of belt 465 and pulley 463, thus altering the film payout speed.

Returning again to the end of housing 476 adjacent stationary ring 460, downstream gear 479 is mounted to downstream roller shaft 475, and engages upstream gear 477 which is mounted to upstream roller shaft 473. Thus, upstream roller 472 rotates in the opposite direction of downstream roller 474 and power pulley 463.

A film roll shaft 454 is mounted to a bracket 471 across ring member 444 at a distance from upstream roller 472 which is at least equal to the radius of a full film roll 456. Film 458 is dispensed from roll 456 across the far side of upstream roller 472, then in an "S" curve between the roller 474. Film path extension means comprising an idler roller 481 is journalled to an idler roller bracket 482 mounted to and across the plane of ring member 444. Film web 458 passes from the downstream roller 474 around idler roller 480 and then onto the load. Idler roller 480 must be positioned less than 90 degrees around ring member 444 from the downstream roller 474, in order to avoid contact of film 458 with the load between the downstream roller 474 and the idler roller 481. The idler roller 481 must also be separated from the downstream roller 474 a distance sufficient to avoid film web contact with housing 476, and also sufficient to expose a large area of film 458 to force variance caused by cornering of the load during wrapping. Bracket 482 may be fixedly mounted perpendicular to ring member 444 or fixed thereto in an angled orientation, or gimballed thereto so that it "floats" or adjusts orientation on one or two axes in response to film path angles.

As best seen in FIGS. 2 and 11, a pair of side conveyors 258 are positioned on either side of the load path and are in close proximity or in contact with opposing vertical side faces of the load 24. Each side conveyor 258 comprises a bracket 236 secured to the frame, a skid-sleeve support 238 supported by the bracket 236, skid-sleeve 278 supported by the skid-sleeve support 238, and upstream pulley 272 and a downstream 274 at opposite ends of the skid-sleeve 278. A side conveyor belt or chain 270 circulates in a downstream pulley direction while exposed at an upper edge of skid-sleeve 278, and then returns in an upstream direction within skid-sleeve 278. Belt 270 encircles pulleys 274 and 272. Upstream pulley 272, bracket 238 and support 236 are preferably located upstream from the wrapping station 441, while the skid-sleeve 278 preferably extends downstream through the wrapping station 441.

A side conveyor motor 262 may be mounted to an overhead portion of frame 42, and is coupled to shaft 264 so as to rotate shaft 264 about its axis. An opposite end of shaft 264 is journalled to bearing 266 also coupled to an upper portion of frame 42. A pair of pulleys 268 are mounted to axle 264 directly above each of the two drive pulleys 276. A vertical belt 269 encircles each overhead pulley 268 and a second sheave of pulley 272 below. Therefore, operation of motor 262 will drive the circulation of side conveyor belts 270. As the upper portion of belt 270 moves downstream, it carries with it any film web 458 which may be wrapped around the load and the skid-sleeve 278. Skid-sleeve 278 is preferably configured of a material chosen for low friction with the film web 458. As each wrapped load passes the downstream end of each side conveyor 158, the tensioned film web which is wrapped against the load 24 will move off of the side conveyors 258 and resume its memory position against the side vertical face of the load 24. Thus, the side conveyors 258 are especially well adapted to maintenance of load integrity under high and variable forces applied during wrapping of the load, and make the present invention especially useful for wrapping loads composed of large numbers relatively small units.

Typical films which can be used in the stretch wrapping apparatus are EVA copolymer films with a high EVA content such as the films manufactured by Consolidated Thermoplastics "RS-50", Bemis "Super-Tough", and PPD "Stay-Tight" films. PVC films such as Borden Resinite "PS-26" can be used in the invention along with premium films such as Mobil-X, Presto premium and St. Regis which utilize a low pressure polymerization process resin manufactured by Union Carbide and Dow Chemical Company. This resin, called linear low density polyethylene, has significantly different stretch characteristics than previous stretch films. These characteristics allow the film to withstand the high stress of extreme elongation without tearing during wrapping of the load.

It should be noted that film, film material and film web are used interchangeably throughout the specification.

The wrapping conveyor assembly 34 as best seen in FIGS. 2 and 7 comprises a conveyor 92 stacked atop first and second side web carrier assemblies 94 and 98. The conveyor 92 comprises an endless driven belt 96 mounted on a plurality of rollers 100, which are supported by a plate 102 secured in turn to a frame member (not shown) holding the rollers in a rotatable position as is well-known in the art. Belt 96 is driven by any conventional motor and roller linkage (not shown). The upper belt segment of conveyor 92 travels in a downstream direction shown by the arrow A with the lower segment of the conveyor returning upstream. The assembly 34 extends through both the two film dispensers 36 and 436. Each of the two side web carriers 94 and 98 comprise a driven sprocket 95 beneath one end of the conveyor 92, a free-wheel sprocket 97 beneath an opposite end of the upper conveyor 92, a chain track 93 positioned to extend between the sprockets 95 and 97, and a chain 91 encircling the sprockets 95 and 97. The chain 91 moves in the direction of load motion along the outside edges of the conveyor 92, and returns in the opposite direction beneath the surface of conveyor 92. The chain is exposed and horizontally supported by the chain track 93 along the edge of the conveyor 92, and is isolated by chain track 93 beneath the conveyor 92. Driven sprockets 95 are driven by a motor means (not shown) of any well known conventional type so that the chain 91 moves at the same linear speed as the conveyor 92. Thus, film web wrapped around the load and the conveyor assembly 34 will engage the portions of chains 91 moving downstream beneath the conveyor 92 and be transported thereby at a uniform speed, and it will not engage either the lower portion of conveyor 92 returning upstream or the interior portions of chains 91 moving upstream.

This construction allows two webs of film to be wrapped around a load 24 carried by the conveyor assembly 34 through the wrapping stations 41 and 441. The stretched webs are wrapped around the conveyor assembly 34 and the load with both the load and wrap being carried by the conveyor assembly in the same direction. When the load encounters the takeoff conveyor 20 as shown in FIG. 2 the stretched webs beneath the conveyor assembly 34 assume memory position M against the bottom of the load in the space between the conveyor assembly 34 and take-off conveyor 20, allowing the contained load covered by stretched wrap to be carried away.

A contnuous sequence of loads may be wrapped in the manner described above, preferably separated on conveyor 34 by spaces S greater than the load height. As shown more clearly in FIG. 4, continuously wrapped loads are taken off of the conveyor 20 and are sealed and severed into separate loads away from the apparatus. The take-off conveyor 220 carries the continuously spiral wrapped loads 224 connected together by the film overwrap from the wrapping stations. The take-off conveyor assembly 220 carries loads 224 more slowly than conveyor 34, in order to decrease the length of spaces S between consecutive loads and the tension on film web in spaces S.

The spiral wrapped bundle 224 as seen in FIG. 4 is severed into individual packages by a guillotine-like cutting apparatus 225 comprising a frame 227, two parallel bars 228 and 230 and a cutter wire 229 mounted to one of the bars. The cutter wire 229 consists of a nichrome wire which is electrically connected to a source of energy. The resistance of the wire causes sufficient heat so that when the wire is reciprocated with the bars between the bundles 224, the wrap is severed forming encapulated loads 124.

The film material may also be simultaneously sealed at each edge, for example by heat applied through the bars, so that the forward edge of one load is sealed as the rearward edge of the preceding load is sealed. As the spiral bundle 224 enters the cutting area, sensor 131 projects a light source through the transparent film in the space S between the individual loads against a photoelectric reflector (not shown) to generate an electrical signal commanding the bar drive circuitry to activate pneumatic cylinders 236 driving together the sealer bars 228 and 230. The cutter wire 229 is activated to cut through the film after the film has been clamped between the bars to sever the load 124 from the wrapped sprial bundle 224. Such sensing apparatus is well known in the art, and any standard circuit can be used to cause the pneumatic cylinders 236 to be activated when the sensor means senses a space between the loads 124. Likewise, a limit switch, contact switch, pressure sensitive switch or other suitable means can be used to activate the cylinders 236. In operation, the bars are driven toward each other during the seal and cut and driven away from each other above and below the load surface for the next seal and cut to provide smooth, efficient operation.

The spiral bundle advances and the next spacing S between the loads 124 is sensed by the light sensor 131. The sealing bars which have been previously driven away from each other allowing the loads to be transported are driven toward each other to seal and sever the wrapped loads in the same manner as previously discussed.

Because of the high throughput of the present invention, loads reach the cutting apparatus 225 before the film web in the spaces S before and behind each load can recover substantially from the pre-stretch operation. Therefore, the film web is in a condition of minimal or zero tension, which permits sealer dwell time for cooling to be reduced to the range of 1 to 4 seconds or completely elminated, further enhancing overall throughput.

A traveling sealer-cutter mechanism 240 can be utilized when steady throughout loads is desired. This type of device, which is well-known and indicated schematically at FIG. 4, surrounds a space S between consecutive loads and moves downstream apace with the loads during the seal and severance operations at the surrounded space S. The mechanism then moves upstream, passing around the load until its trailing end and the next space S are encountered, at which point the operation can be repeated.

Following severance, the film web recovers or retracts over time against the leading and trailing load ends to exert containment forces thereon. In the prior art, by contrast, film web was sealed at load ends only after recovery and under significant tension, which required far longer sealer bar contact and load motion interruption to cool the heated seal, or else under no tension and no corresponding end-to-end containment force.

In the operation of the inventive wrapping apparatus, feed conveyor 32 brings two initial loads 24 onto the wrapping conveyor assembly 34 which then carries the loads to predetermined wrap positions 41 and 441 within the rings 44 and 444 respectively, and the conveyor assembly stops, leaving the loads in stationary positions. The leading edge of the film web 58 is tucked against the load within ring 44 and the leading edge of web 458 is tucked against the load within ring 444. Rotation of rings 44 and 444 is then begun. Loads 24 are continuously carried through wrapping stations 41 and 441 by conveyor assembly 34, and rings 44 and 444 are rotated continuously.

Because rings 44 and 444 are rotated continuously, the spaces S between loads are wrapped, with the empty wrap being supported by the wrapping conveyor 34 and the side conveyors 158 and 258. However, the recovery speed of film stretched past its yield point is slow enough that the empty wrap between loads is not under initial tension, which permits a seal to be formed with a very short dwell time.

As ring 44 rotates, film is drawn across the surface of downstream roller 74 to encircle the load. The contact of pulley 63 with belt 65 forces pulley 63 to rotate, thereby rotating shaft 61 and transfer pulley 66. Transfer pulley 66 drives belt 67 and pulley 68, which drives roller 74. The rotation speed of roller 74 is therefore proportional to the rotation speed of the ring member 44. The rotation speed of upstream roller 72 is held to a constant ratio of that of downstream roller 74, through gears 79 and 77, so that upstream roller 72 draws film 58 from film roll 56 and the film web is stretched during passage between the rollers 72 and 74 due to the speed differential therebetween.

Thus, the force experienced by the load is reduced, and the variations in speed required by the film web due to corner passage on the load is controlled by the apparatus without rupture of the film.

As film payout reduces the diameter of film roll 56, friction in film mandrel 54 prevents slack on web 58 between roll 56 and roller 72. Alternatively, frame 84 is pivoted and roller 57 is urged against roll 56 to maintain roll payout speed at or below the surface speed of roller 72.

Chains 170 and 186 are driven to match the speed of conveyor assembly 34, so web 58 in contact with chains 170 and 186 is transported downstream by the chains. As the loads pass each downstream pulley 174, the web 58 leaving contact with belts 170 recovers or retracts under tension against the sides of each load 24.

Ring 444 is rotated in the opposite direction from that of ring 44 so that the helical forces applied to the loads by web 58 will be balanced by the opposing helical forces of web 458, and longitudinal and circumferential forces will be reinforced.

As ring 444 rotates, film 458 is drawn across the surface of downstream roller 474 to encircle the load. The contact of pulley 463 with belt 465 forces pulley 463 to rotate, thereby rotating shaft 461 and transfer pulley 466. Transfer pulley 466 drives belt 467 and pulley 468, which drives roller 474. The rotation speed of roller 474 is therefore proportional to the rotation speed of the ring member 444. The rotation speed of upstream roller 472 is held to a constant ratio of that of downstream roller 474, through gears 479 and 477, so that upstream roller 472 draws film 458 from film roll 456 and the film web is stretched during passage between the rollers 472 and 474 due to the speed differential therebetween.

Thus, the force experienced by the load is reduced, and the variations in speed required by the film web due to corner passage on the load is controlled by the apparatus without rupture of the film.

Take-off conveyor 20, positioned to accept loads from the end of conveyor assembly 34, is constructed like the infeed conveyor and runs at a fixed fraction of the speed of the infeed conveyor. A suitable mechanical means (not shown) may be set up to make the drive of both the infeed conveyor and the take-off conveyor proportional to the reduction gearing assembly of the drive motor. Thus, if the motor slows down or speeds up to drive the wrapping mechanism at different speeds, the infeed and take-off conveyors are simultaneously speeded up or slowed down so that the load is moved to conveyor assembly 34 and taken away from the conveyor assembly 34 at consistent relative speed.

As film payout reduces the diameter of film roll 456, friction in film mandrel 454 prevents slack on web 458 between roll 456 and roller 472. Alternatively, frame 484 is pivoted and roller 457 is urged against roll 456 to maintain roll payout speed at or below the surface speed of roller 472.

Chains 270 are driven to match the speed of conveyor assembly 34, so web 458 in contact with chains 270 and 186 is transported downstream. As the loads pass each downstream pulley 274, the web 458 leaving contact with belts 270 recovers or retracts under tension against the sides of each load 24. As the loads cross over the downstream end of conveyor assembly 34, the webs 58 and 458 leaving contact with chains 91 recover or retract under tension against the bottom face of each load 24.

The empty wraps between the loads are then severed and optionally sealed as previously discussed, and the sealed loads are taken away to another transport area. The end wraps recover after severance to gradually apply end-to-end containment forces.

It should be noted that the steps of the wrapping can be interchangeable without departing from the scope of the present invention. Furthermore, these steps can be interchanged and are equivalent. In the foregoing description, the invention has been described with reference with a particular preferred embodiment, although it is to be understood that the specific details shown are merely illustrative, in the invention may be carried out in other ways without departing from the true spirit and scope of the following claims.

What is claimed is:

1. An apparatus for wrapping a load to contain the load comprising:

wrapping conveyor means for conveying the load and a wrapped web in a longitudinal direction relative to first and second film dispensing means;

said first film dispensing means having means for stretching and wrapping a first web around the load and onto at least part of the wrapping conveyor means, means for rotating said first dispensing means in a first circumferential direction around the load while the load is conveyed in the longitudinal direction relative to the first film dispensing means to form a first helical layer which is formed and biased in a first helical direction;

said second film dispensing means having means for stretching and wrapping a second web around the load and onto the first helical layer of web, means for rotating said second dispensing means in a second circumferential direction around the load opposite the first circumferential direction while the load is conveyed in the longitudinal direction relative to the second film dispensing means to form a second helical layer which is formed and biased in a second helical direction opposite the first helical direction, and for producing in combination with the first helical layer a containment force on the wrapped conveyor means having longitudinal and circumferential components without a substantial helical component, at least one of the longitudinal and circumferential components being substantial; and means for transferring the first and second helical layers as a unit from the wrapping conveyor means onto the load to apply a containment force on the load having longitudinal and circumferential components without a substantial helical component, at least one of the longitudinal and circumferential components being substantial.

2. The apparatus of claim 1 wherein the wrapping conveyor means includes side conveyor means positioned along at least two sides of the load for supporting and conveying the first and second webs as they are wrapped around the load.

3. The apparatus of claim 1 wherein the conveyor means conveys a series of loads in the longitudinal direction for continuous wrapping of the series of loads.

4. A method for wrapping a load to contain the load comprising:

conveying the load in a longitudinal direction on a wrapping conveyor relative to first and second wrapping means;

rotating a first web around the load in a first circumferential direction and, stretching and wrapping the first web around the load and onto at least part of the wrapping conveyor in the first circumferential direction with said first wrapping means during said conveying step to form a first helical layer which is formed and biased in a first helical direction;

rotating a second web around the load in a second circumferential direction opposite the first circumferential direction and, stretching and wrapping the second web around the load and onto the first helical layer of web in the second circumferential direction opposite the first circumferential direction with said second wrapping means during said conveying step to form a second helical layer which is formed and biased in a second helical direction opposite the first helical direction, and producing in combination with the first helical layer a containment force on the wrapped conveyor having longitudinal and circumferential components without a substantial helical component, at least one of the longitudinal and circumferential components being substantial; and conveying both the load and the wrapped webs on the wrapping conveyor in a longitudinal direction and transferring the first and second helical web layers as a unit from the wrapping conveyor onto the load to apply a containment force on the load having longitudinal and circumferential components without a substantial helical component, at least one of the longitudinal and circumferential components being substantial.

5. The method of claim 4 including prestretching the first and second webs in a web dispenser prior to wrapping the web around the load.

6. The method of claim 4 including severing the first and second webs in front of and behind the load to allow the webs to recover and apply a longitudinal and circumferential containment force on the load.

7. The method of claim 4 including dispensing the first and second webs at a constant supply speed.

8. The method of claim 4 including assembling a load from multiple sub-units prior to wrapping.

9. The method of claim 4 including wrapping the first web around a wrapping conveyor positioned on at least two sides of the load.

10. The method of claim 4 including stretching the first and second webs beyond the yield point during the dispensing step.

11. The method of claim 4 including wrapping the first web onto a wrapping conveyor positioned below and on two sides of the load.

12. The method of claim 4 including prestretching the first and second webs between an upstream roller and a downstream roller in a web dispenser.

13. The method of claim 4 including conveying the load and the first and second helical layers on the wrapping conveyor at a common speed.

14. The method claimed in claim 4 wherein at least one of the first and second webs is wrapped over at least a portion of itself.

15. The method of claim 4 including continuously stretching and wrapping the first and second webs.

16. The method of claim 4 including positioning the wrapping conveyor to support a substantial portion of the containment force of the webs during wrapping.

17. The method of claim 4 wherein the load and the wrapped webs are conveyed at a common speed.

18. The method of claim 4 including wrapping a load having a length in the longitudinal direction which is shorter than the effective width of the web in the longitudinal direction.

19. The method of claim 4 wherein the step of conveying includes conveying a series of loads in the longitudinal direction for continuous wrapping of the series of loads.

20. An apparatus for wrapping a load to contain the load comprising:

conveyor means for conveying the load in a longitudinal direction relative to first and second film dispensing means;

said first film dispensing means having means for stretching and wrapping a first web around the load, means for rotating said first dispensing means in a first circumferential direction around the load while the load is conveyed in the longitudinal direction relative to the first film dispensing means to form a first helical layer which is formed and biased in a first helical direction;

said second film dispensing means having means for stretching and wrapping a second web around the load and onto the first helical layer of web, means for rotating said second dispensing means in a second circumferential direction opposite the first circumferential direction while the load is conveyed in the longitudinal direction relative to the second film dispensing means to form a second helical layer which is formed and biased in a second helical direction opposite the first helical direction, and for producing in combination with the first helical layer a containment force having longitudinal and circumferential components without a substantial helical component, at least one of the longitudinal and circumferential components being substantial.

21. The apparatus of claim 20 wherein the conveyor means conveys a series of loads in the longitudinal direction for continuous wrapping of the series of loads.

22. A method for wrapping a load to contain the load comprising:

conveying the load in a longitudinal direction relative to first and second wrappings means;

rotating a first web around the load in a first circumferential direction, and stretching and wrapping the first web around the load with said first wrapping means during said conveying step to form a first helical layer which is formed and biased in a first helical direction;

rotating a second web around the load in a second circumferential direction opposite the first circumferential direction and stretching and wrapping the second web around the load and onto the first helical layer of web in the second circumferential direction opposite the first circumferential direction with said second wrapping means during said conveying step to form a second helical layer which is formed and biased in a second helical direction, and producing in combination with the first helical layer a containment force having longitudinal and circumferential components without a substantial helical component, at least one of the longitudinal and circumferential components being substantial.

23. The method of claim 22 wherein the step of conveying includes conveying a series of loads in the longitudinal direction for continuous wrapping of the series of loads.

24. The method of claim 22 including prestretching the first and seconds webs in a web dispenser prior to wrapping the web around the load.

25. The method of claim 22 including severing the first and second webs in front of and behind the load to allow the webs to recover and apply a longitudinal and circumferential containment force on the load.

26. The method of claim 22 including dispensing the first and second webs at a constant supply speed.

27. The method of claim 22 including assembling a load from multiple sub-units prior to wrapping.

28. The method of claim 22 including stretching the first and second webs beyond the yield point during the dispensing step.

29. The method of claim 22 including prestretching the first and second webs between an upstream roller and a downstream roller in a web dispenser.

30. The method claimed in claim 22 wherein at least one of the first and second webs is wrapped over at least a portion of itself.

31. The method of claim 22 including continuously stretching and wrapping the first and second webs.

32. The method of claim 22 wherein the load and the wrapped webs are conveyed at a common speed.

33. The method of claim 22 including wrapping a load having a length in the longitudinal direction which is shorter than the effective width of the web in the longitudinal direction.

* * * * *